US008405673B2

(12) United States Patent
Sasaki

(10) Patent No.: US 8,405,673 B2
(45) Date of Patent: Mar. 26, 2013

(54) COLOR PROCESSING APPARATUS AND COLOR PROCESSING METHOD

(75) Inventor: Yoshitaka Sasaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 832 days.

(21) Appl. No.: 12/580,141

(22) Filed: Oct. 15, 2009

(65) Prior Publication Data

US 2010/0103188 A1 Apr. 29, 2010

(30) Foreign Application Priority Data

Oct. 28, 2008 (JP) ..... 2008-277142

(51) Int. Cl.
*G09G 5/02* (2006.01)

(52) U.S. Cl. ..... 345/589; 345/590; 345/591; 345/593

(58) Field of Classification Search ..... 345/589, 345/590, 591, 593
See application file for complete search history.

(56) References Cited

U.S. PATENT DOCUMENTS 6,204,873 B1 * 3/2001 Shimazaki ..... 347/172
6,414,756 B1 * 7/2002 Tsukada ..... 358/1.9
6,594,388 B1 * 7/2003 Gindele et al. ..... 382/167
6,791,716 B1 * 9/2004 Buhr et al. ..... 358/1.9
6,850,245 B1 * 2/2005 Murashita et al. ..... 345/589
2002/0122589 A1 * 9/2002 Reiman et al. ..... 382/167
2002/0159083 A1 * 10/2002 Arai et al. ..... 358/1.9
2002/0168104 A1 * 11/2002 Muramoto ..... 382/167
2007/0013927 A1 * 1/2007 Miyahara et al. ..... 358/1.9
2007/0058186 A1 * 3/2007 Tanaka ..... 358/1.9
2008/0282915 A1 * 11/2008 Horita ..... 101/211
2009/0022511 A1 * 1/2009 Kubo et al. ..... 399/83

FOREIGN PATENT DOCUMENTS

JP 2005-210646 A 8/2005

* cited by examiner

*Primary Examiner* — David T Welch
(74) *Attorney, Agent, or Firm* — Canon USA Inc IP Division

(57) ABSTRACT

An appropriate color matching can be realized, even if a viewing environment is changed, by acquiring a viewing condition under which a user views a color image, generating output data for outputting a color chart including color patches corresponding to acquired viewing condition, acquiring colorimetric values of the color patches contained in the color chart obtained by outputting the generated output data using an output device, and generating a profile concerning color processing condition according to the viewing condition based on acquired colorimetric values.

3 Claims, 11 Drawing Sheets

| TYPES | BROAD-BAND TYPE | THREE-BAND TYPE | NORMAL TYPE |
|---|---|---|---|
| 4000 | Chart01 | Chart02 | Chart03 |
| 4000～6000 | Chart04 | Chart05 | Chart06 |
| 6000 | Chart07 | Chart08 | Chart09 |

COLOR PROCESSING APPARATUS AND COLOR PROCESSING METHOD

BACKGROUND OF THE INVENTION

1. Field of the Invention

The present invention relates to a color processing apparatus for outputting a color chart, and to a color processing method.

2. Description of the Related Art

Along with the widespread use of devices for handling color images, applications such as outputting color images by using a plurality of printers at offices, and outputting created color images at transmitting and receiving destinations via a network are on the increase. In such a case, even if color image data is the same, reproduced colors can become different due to difference between characteristics of individual devices, eventually presenting a problem. This is because color representation method (e.g., Red-Green-Blue (RGB) or Cyan-Magenta-Yellow-blacK (CMYK)) and reproducible color range (hereinafter, the reproducible color range is referred to as "color gamut") are varied from device to device.

Therefore, in order to match colors of devices with each other, it is necessary to perform color conversion processing to appropriately correct difference in color gamuts for each device in device-independent color space (Commission Internationale de l'Eclairage (CIE) L*a*b* Space (CIELAB) and CIE Color Appearance Model (CIECAM) 02). For instance, if a color image displayed on a monitor is output by a printer, a color gamut of a monitor is generally wider than a color gamut of a printer. In this case, color processing for converting colors which cannot be reproduced by the printer into colors which can be reproduced by the printer is needed In recent years, as a color matching technique for matching the colors of devices with each other, a color management system (CMS) has been discussed. General CMS uses a profile (for instance, International Color Consortium (ICC) profile) which indicates device characteristics. For instance, a profile of a printer is created by printing a color chart including a predetermined color patch, measuring a print result with a dedicated measurement device, and then processing a measurement result in a computer where a dedicated program is executed. In the profile, a corresponding relationship between device-dependent color space and device-independent color space is described, and the color matching is realized by correcting colors of color images using the profile. Therefore, it is important to use an appropriate profile for realizing the color conversion processing with a high precision On the other hand, device characteristics are different depending on viewing environments of an output product of color images. For instance, even if the same color images are output by the same device, colors perceived by humans are viewed differently between the cases where light sources in a room are a fluorescent light and an incandescent light. Thus, there is discussed a method for estimating a color appearance under a desired light source in order to correct color appearance variations resulting from such differences in viewing conditions of an image (e.g., Japanese Patent Application Laid-Open No. 2005-210646).

Conventionally, a profile was generated using a color chart of a particular color patch configuration which is not dependent on viewing conditions of an output product. However, if the viewing conditions of an image are changed, device characteristics, namely, a color gamut shape is also changed. As a result, there is a problem that a bias occurs in a distribution of the color patches of the color chart, and thus a color reproduction precision of the profile is lowered. Further, Japanese Patent Application Laid-Open No. 2005-210646 does not relate to a technique for suitably creating the color chart.

SUMMARY OF THE INVENTION

The present invention is directed to a color processing apparatus, a color processing method and a program that enable realizing appropriate color matching even if a viewing environment is changed.

According to an aspect of the present invention, a color processing apparatus includes a viewing condition acquisition unit configured to acquire a viewing condition under which a user views color image, a color chart output unit configured to output a color chart including color patch corresponding to the viewing condition, a colorimetric value acquisition unit configured to acquire a colorimetric value of the color patch included in the color chart output from the color chart output unit, and a generation unit configured to generate a profile concerning color processing condition according to the viewing condition, based on the colorimetric value acquired by the colorimetric value acquisition unit.

According to another aspect of the present invention, a color processing method includes acquiring viewing condition under which a user views a color image, outputting a color chart including the color patch corresponding to the viewing condition, acquiring colorimetric value of the color patch included in the output color chart, and generating a profile concerning color processing condition according to the viewing condition, based on the acquired colorimetric value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
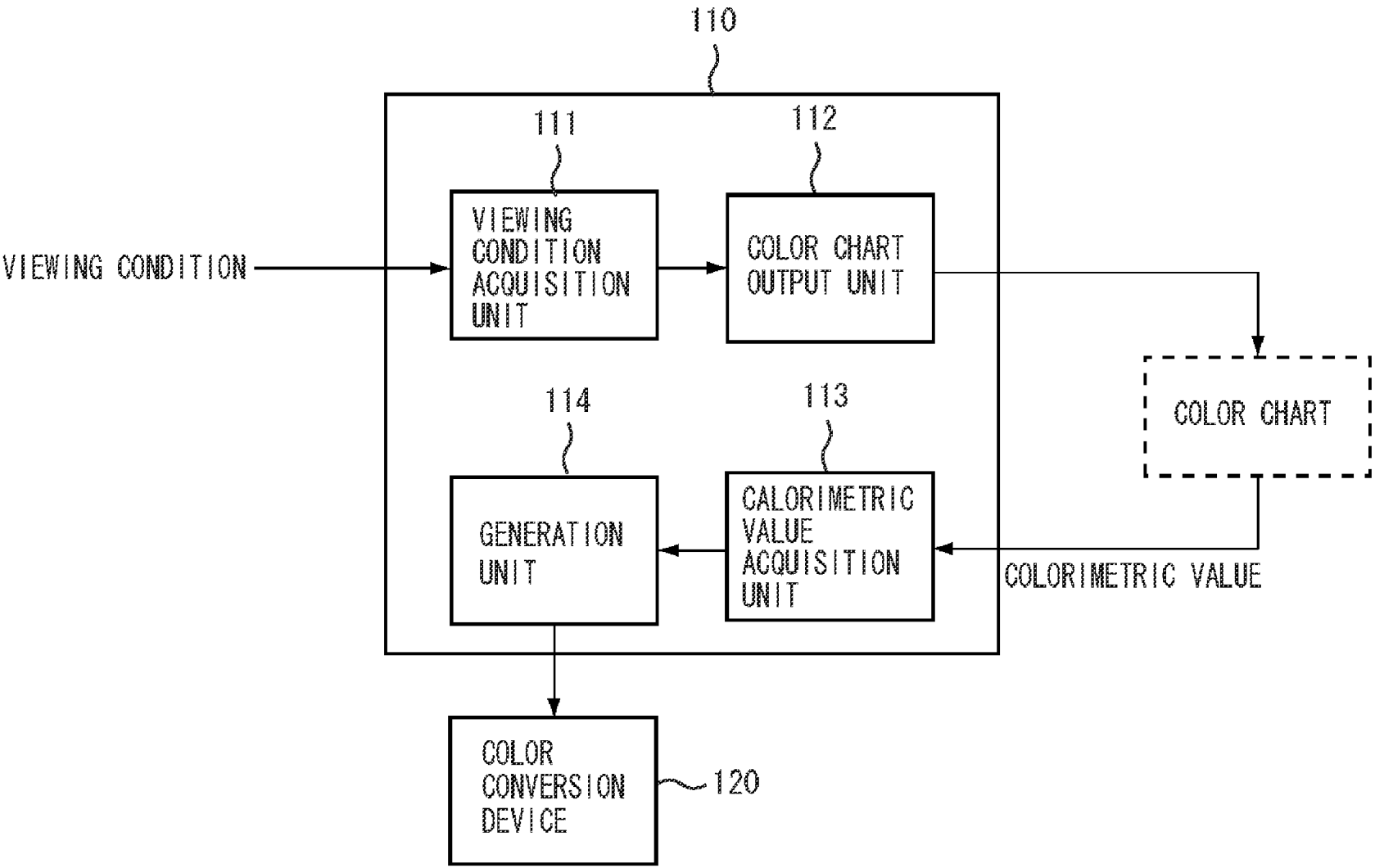
FIG. 1 is a schematic view illustrating an example of schematic configuration of a color processing system according to a first exemplary embodiment.

Now, a first exemplary embodiment will be described. FIG. 1 is a schematic view illustrating an example of schematic configuration of a color processing system 100 according to a first exemplary embodiment.

The color processing system 100 in the first exemplary embodiment is configured to include, as illustrated in FIG. 1, a color processing apparatus 110, and a color conversion apparatus 120. Further, the color processing apparatus 110 is configured to include a viewing condition acquisition unit 111, a color chart output unit 112, a colorimetric value acquisition unit 113, and a generation unit 114.

The viewing condition acquisition unit 111 acquires a viewing condition such as type of light source and color temperature of an environment where a user views an output product of a color image.

The color chart output unit 112 includes a plurality of color charts, and selects (or generates) a color chart (color chart image) which includes a color patch (color patch image) based on the viewing condition acquired by the viewing condition acquisition unit 111, and then outputs it to an output medium. The color chart includes a plurality of color patches, where necessary.

The colorimetric value acquisition unit 113 acquires a colorimetric value obtained when color-measuring a color chart output from the color chart output unit 112 to an output medium using a measurement device or the like.

The generation unit 114 generates a profile concerning the color processing condition suitable for the viewing condition acquired by the viewing condition acquisition unit 111, based on the colorimetric value acquired by the colorimetric value acquisition unit 113.

The color conversion apparatus 120 performs color conversion processing of color image which has been input, using a profile generated by the generation unit 114.

Figure 2:
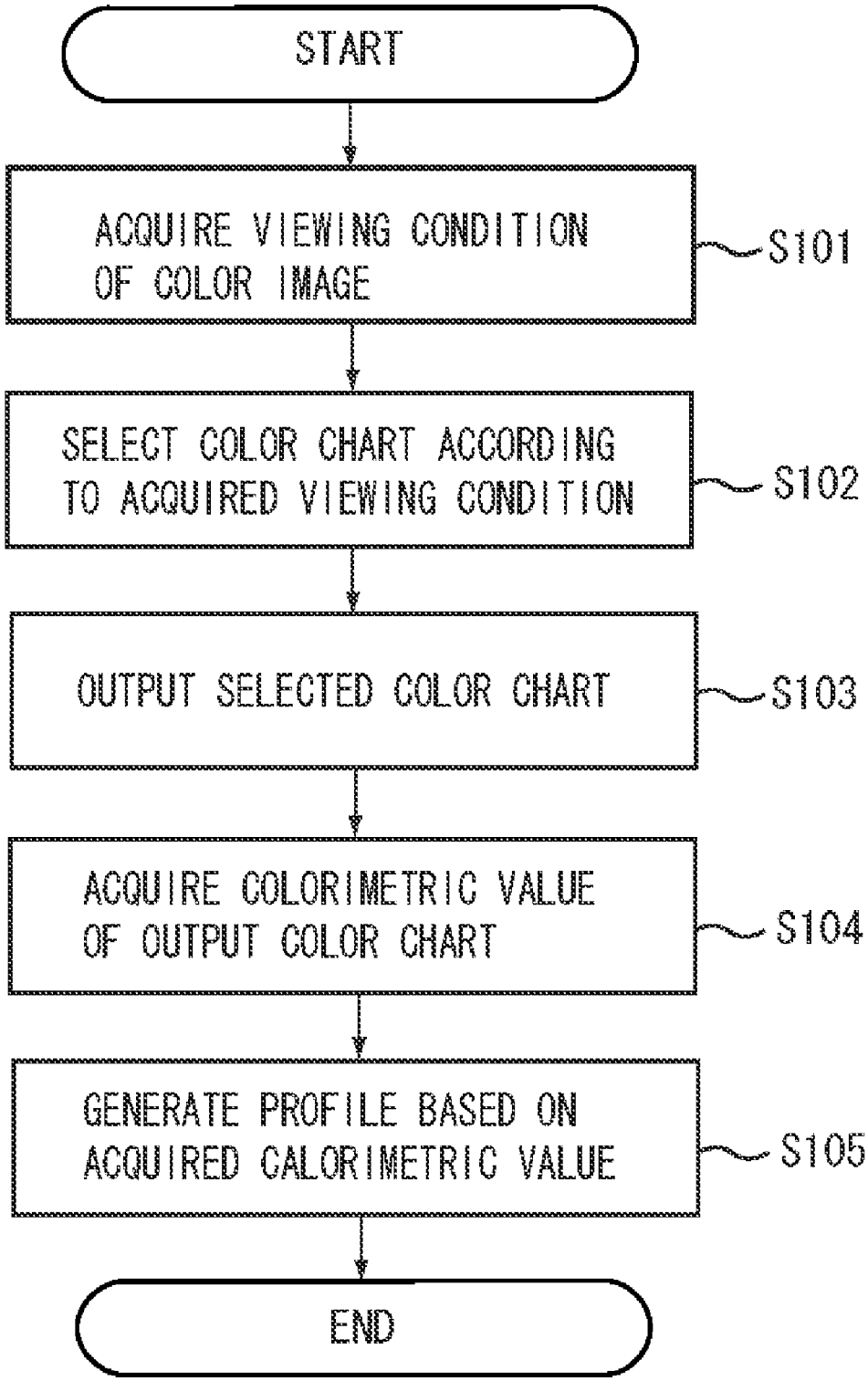
FIG. 2 is a flowchart illustrating the first exemplary embodiment, and illustrating an example of a procedure for a color processing method in a color processing apparatus illustrated in FIG. 1.

Next, a procedure of color processing in the color processing apparatus 110 illustrated in FIG. 1 will be described. FIG. 2 is a flowchart illustrating the first exemplary embodiment, and illustrating an example of the procedure of a color processing method in the color processing apparatus 110 illustrated in FIG. 1. In the flowchart illustrated in FIG. 2, the processing for implementing a color processing suitable for a viewing condition which a user has set will be described.

In step S101 of FIG. 2, the viewing condition acquisition unit 111 acquires a viewing condition under which the color image which the user has set is viewed. In the process, as the viewing condition, it is desirable to acquire at least information about types of light source and color temperature of light source. In addition, the viewing condition can be set by the user in a desired method, using, for instance, a user interface illustrated in FIG. 3.

Figures 3, 4:
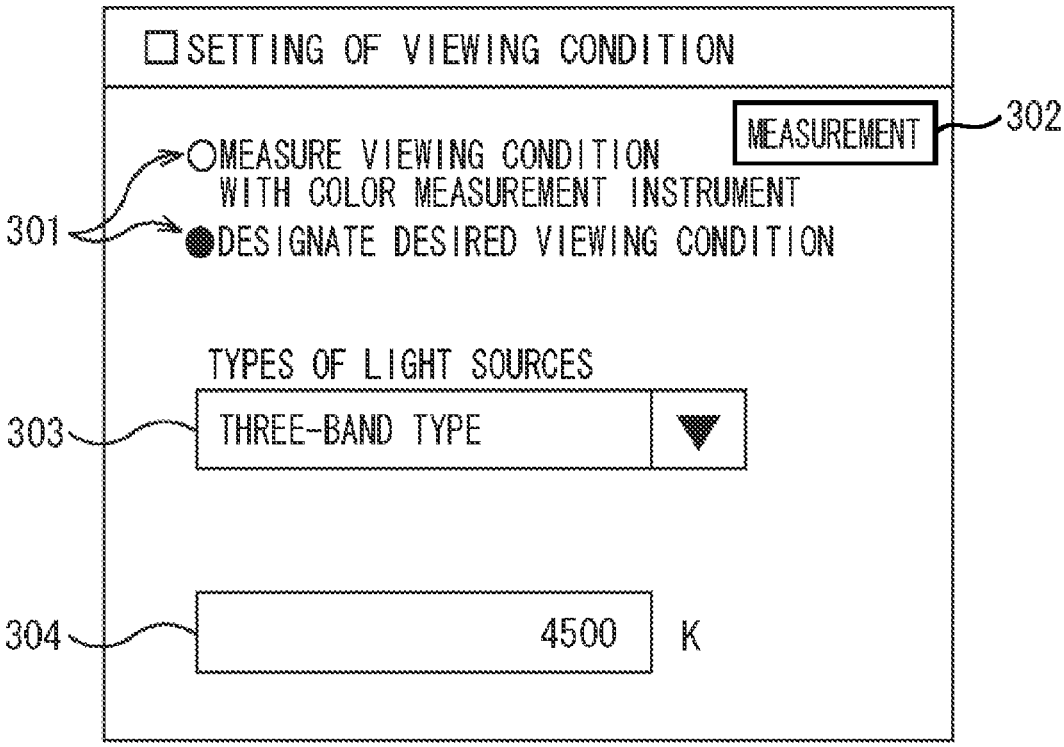
FIG. 3 is a schematic view illustrating the first exemplary embodiment, and illustrating an example of a user interface (UI) used when the viewing condition is set.
FIG. 4 is a schematic view illustrating the first exemplary embodiment, and illustrating an example of a color chart selection table used when a color chart is selected according to the viewing conditions by a color chart output unit illustrated in FIG. 1.

FIG. 3 is a schematic view illustrating the first exemplary embodiment, and illustrating an example of a user interface (UI) used when viewing conditions are set. In FIG. 3, a radio button 301 is a button for selecting a setting method of the viewing condition. A measurement button 302 is a button for giving an instruction to measure the viewing condition. A list box 303 is a box for selecting a type of light source. An edit box 304 is a box for designating a color temperature of the light source.

For instance, if a location where the color image is viewed is the same as the color processing apparatus 110, and a measurement device which can measure the viewing condition is available, after selecting "measure viewing condition with measurement device" with the radio button 301, a measurement result can be set according to an instruction from the measurement button 302 as the viewing condition.

Further, for instance, if a location where the color image is viewed is away from the color processing apparatus 110 or a measurement device is not available, "designate desired viewing condition" is selected with the radio button 301. Then, a viewing condition close to desired viewing environment may be defined and set from among conditions which can be set to the list box 303 and the edit box 304. In FIG. 3, these cases are illustrated, and conditions that a type of light source is "three-band type", and a color temperature of light source is "4500K" are indicated as the viewing conditions.

Returning to FIG. 2, in step S102, the color chart output unit 112 performs processing for selecting the color chart showing the suitable color patch configuration, based on the viewing condition acquired in step S101. A selection method of the color chart will be described with reference to FIG. 4.

FIG. 4 is a schematic view illustrating the first exemplary embodiment, and illustrating an example of a color chart selection table used when a color chart is selected according to a viewing condition by the color chart output unit 112 illustrated in FIG. 1. The color chart election table illustrated in the FIG. 4 is internally held, for instance, in the color chart output unit 112 together with the color chart.

For instance, if a type of light source illustrated in FIG. 3 is a "three-band type", and a color temperature of light source is "4500K", the color chart output unit 112 selects a color chart of "Chart 05" by referring to the color chart selection table illustrated in FIG. 4. Further, if a color temperature of light source is 4000K, either of a color chart at upper tier and a color chart at middle tier may be selected. Still further, if a color temperature of light source is 6000K, either of a color chart at middle tier and a color chart at lower tier may be selected.

A selection method of a color chart is not limited to a method using the color chart selection table such as the one illustrated in FIG. 4, but the color chart can be simplified or subdivided according to desired viewing condition. Further, regarding correspondence between viewing condition and color chart, a user may check a shape of color gamut in advance for each assumed viewing condition, and create beforehand a color chart in suitable color patch configuration.

In this case, relationships between viewing conditions and color gamuts of device will be described with reference to FIG. 5 and FIG. 6.

Figure 5A:
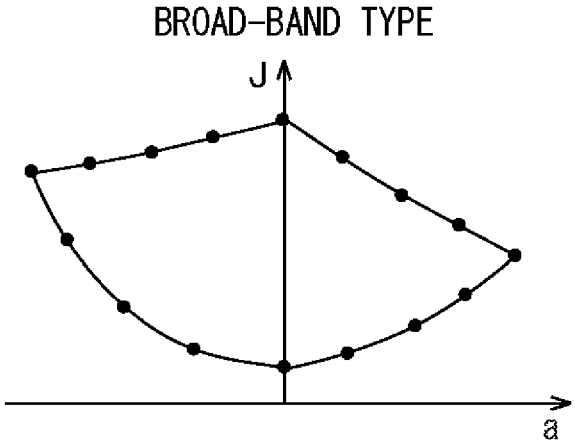
FIGS. 5A and 5B are schematic views illustrating the first exemplary embodiment, and illustrating examples of density of color patches according to the viewing condition.
Figure 5B:
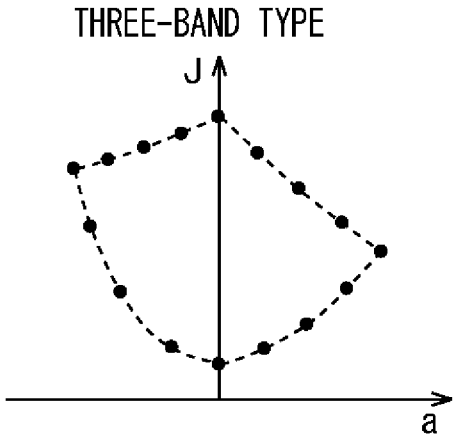

FIGS. 5A and 5B are schematic views illustrating the first exemplary embodiment, and illustrating examples of density of color patches according to viewing conditions. More specifically, FIGS. 5A and 5B are schematic views in which color gamuts of a certain device are projected on Ja planes in appearance color space defined by CIECAM02, and black points of FIG. 5 indicate color signal values of the color patches. In FIGS. 5A and 5B, FIG. 5A illustrates "broad-band type", and FIG. 5B illustrates "three-band type" in terms of type of light source, respectively.

FIGS. 5A and 5B indicate that, even when the same device is used, if a type of light source of a viewing environment is changed, a shape of a color gamut is changed. If a type of the light source illustrated in FIG. 5A is a "broad-band type", a color gamut of the device becomes broader in an a-axis direction. On the contrary, if a type of the light source illustrated in FIG. 5B is a "three-band type", a color gamut of the device becomes narrower in the a-axis direction. Further, in a case where a color temperature of the light source in a viewing environment is changed, a shape of the color gamut is also changed, similarly to the type of the light source. In general, when a color temperature of the light source becomes low, a device color gamut becomes broader in a positive direction of the a-axis, and becomes narrower in a negative direction of the a-axis. On the contrary, when a color temperature of the light source becomes high, the device color gamut is broadened in a negative direction of the a-axis, and is narrowed in a positive direction of the a-axis.

In this manner a color gamut shape of a device is changed according to a viewing condition. As a result, when a profile depending on each viewing condition is generated using a color chart of the same color patch configuration, characteristics of the profile is changed for each viewing condition. In the cases illustrated in FIGS. 5A and 5B, when the type of the light source illustrated in FIG. 5A is a "broad-band type", a distribution (array) of the color patches becomes coarse in the a-axis direction. On the other hand, when the type of the light source illustrated in FIG. 5B is a "three-band type", a distribution (array) of the color patches becomes dense in the a-axis direction. For this reason, in the "broad-band type", color reproduction precision may be lowered in a color gamut which is broader in the a-axis direction such as red. Hence, it is required to generate a profile with stable precision, without being dependent on the viewing condition.

Figure 6A:
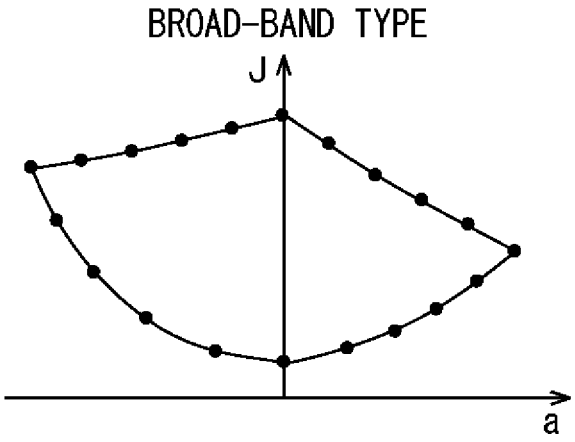
FIGS. 6A and 6B are schematic views illustrating the first exemplary embodiment, and illustrating examples of corrections of density of color patches according to the viewing conditions.
Figure 6B:
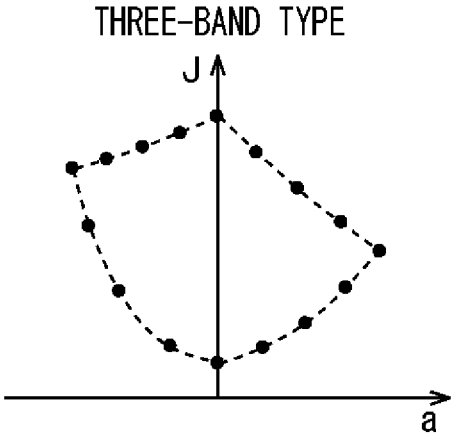

FIGS. 6A and 6B are schematic views illustrating the first exemplary embodiment, and illustrating examples of corrections of density of color patch array according to a viewing condition. More specifically, FIGS. 6A and 6B, similarly to FIGS. 5A and 5B, are schematic views in which the color gamuts of a certain device is projected on Ja planes, in an appearance color space defined by CIECAM 02. FIG. 6A illustrates a schematic view in which a type of the light source is a "broad-band type", and FIG. 6B illustrates a schematic view in which a type of the light source is a "three-band type".

However, in FIGS. 6A and 6B, a density of the color patch array is reduced (made small) by changing the color patch configuration at the "broad-band type" side, in contrast to FIGS. 5A and 5B, and adding color patches in the a-axis direction. In this manner, in the color chart output unit 112 of the exemplary embodiment, a color chart is selected which suitably changes a color patch configuration (namely, the color chart is selected in which the color patch configuration is different) according to a color gamut shape for each viewing condition. Consequently, a suitable profile for desired viewing condition can be generated in the generation unit 114 described below.

Returning to FIG. 2, in step S103, the color chart output unit 112 outputs a color chart selected in step S102 to an output medium. After that, the color chart which has been output on the output medium is, separately, color-measured using a calorimeter or the like. In this case, data of colorimetric values acquired by the color measurement may be acceptable as long as a corresponding relationship between device-dependent color signal value and device-independent color signal value is established.

Next, in step S104, the colorimetric value acquisition unit 113 acquires a colorimetric value obtained when a color chart output to the output medium in step S103 is color-measured using a calorimeter or the like.

In step S105, the generation unit 114 generates a profile concerning a color processing condition, based on the colorimetric value acquired in step S104. The profile concerning the color processing condition generated in step S105 is concerned with mutual conversion conditions of device-dependent color signal values (e.g., RGB values) and device-independent color signal values (e.g., Jab values). In the case of general printers, a table (look-up table: LUT) representing the corresponding relationship thereof is generated, and described in the profile.

Figure 7:
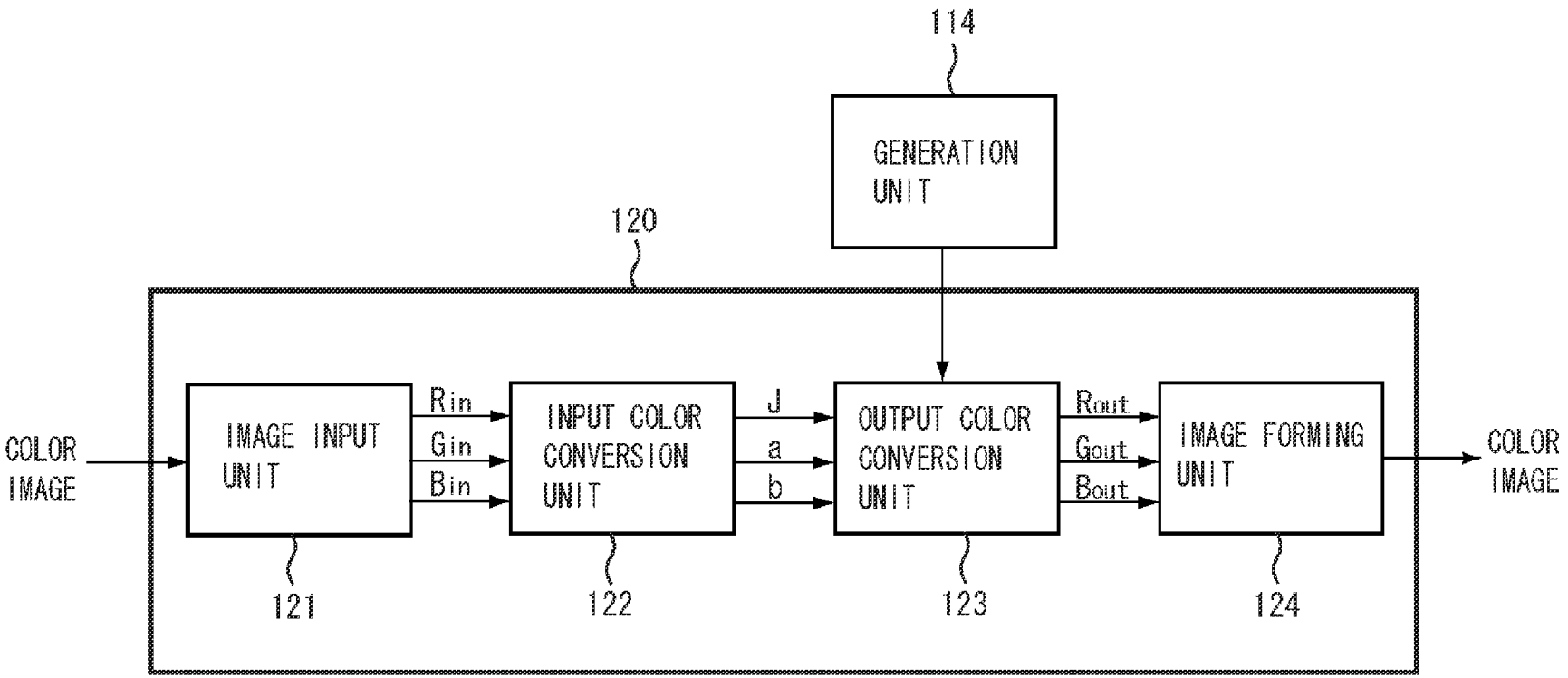
FIG. 7 is a schematic view illustrating the first exemplary embodiment, and illustrating an example of internal configuration regarding the color conversion processing of the color conversion apparatus illustrated in FIG. 1.

FIG. 7 is a schematic view illustrating the first exemplary embodiment, and illustrating an example of internal configuration concerning the color conversion processing of the color conversion apparatus 120 illustrated in FIG. 1.

The color conversion apparatus 120 is configured to include, as illustrated in FIG. 7, an image input unit 121, an input color conversion unit 122, an output color conversion unit 123, and an image forming unit 124.

First, the image input unit 121 performs input processing of RGB images (color images). Next, the input color conversion unit 122 performs conversion processing of RGB values of the color image input from the image input unit 121 into Jab values, using corresponding predetermined profile. Next, the output color conversion unit 123 performs conversion processing of Jab values output from the input color conversion unit 122 into RGB values, using a profile in which the color processing condition generated by the generation unit 114 is described. Then, the image forming unit 124 forms an output image (color image) to be output to an output product based on RGB values output from the output color conversion unit 123. In this manner, the color conversion processing is performed by the color conversion apparatus 120.

In the similar configuration to the present exemplary embodiment, by using an existing (reference) color processing condition, and correcting it for each viewing condition, a profile concerning the color processing condition according to the viewing condition can be generated. In this case, for instance, in step S101 of FIG. 2, the viewing condition acquisition unit 111 acquires the viewing condition from a profile which is subjected to correction. Further, for instance, in step S102 of FIG. 2, the color chart output unit 112 can select a color chart including the color patches for use in profile correction for each viewing condition. Furthermore, for instance, in step S105 of FIG. 2, the generation unit 114 corrects the existing (reference) color processing condition based on the colorimetric value acquired in step S104, and generates a profile concerning the color processing condition according to the viewing condition acquired in step S101.

Consequently, a profile concerning the existing (reference) color processing condition can be corrected according to the desired viewing condition.

According to the first exemplary embodiment, a color chart is output which includes color patches corresponding to a viewing condition under which a user views a color image. As a result, highly precise color processing according to the viewing condition can be performed by creating a profile, based on the measurement result. Consequently, appropriate color matching can be realized, even if a viewing environment is changed.

Next, a second exemplary embodiment will be described. In the above-described first exemplary embodiment, a color chart of a color patch configuration is selected which is suited to a color gamut shape of a device in a viewing condition of an environment in which a user views a color image, and a profile concerning a color conversion condition is generated from colorimetric values thereof. In this case, from a reference color patch configuration according to a certain reference viewing condition, a color patch configuration corresponding to a desired viewing condition can be also dynamically generated depending on the intended use. Then, the form will be described hereinafter as a second exemplary embodiment.

Figure 8:
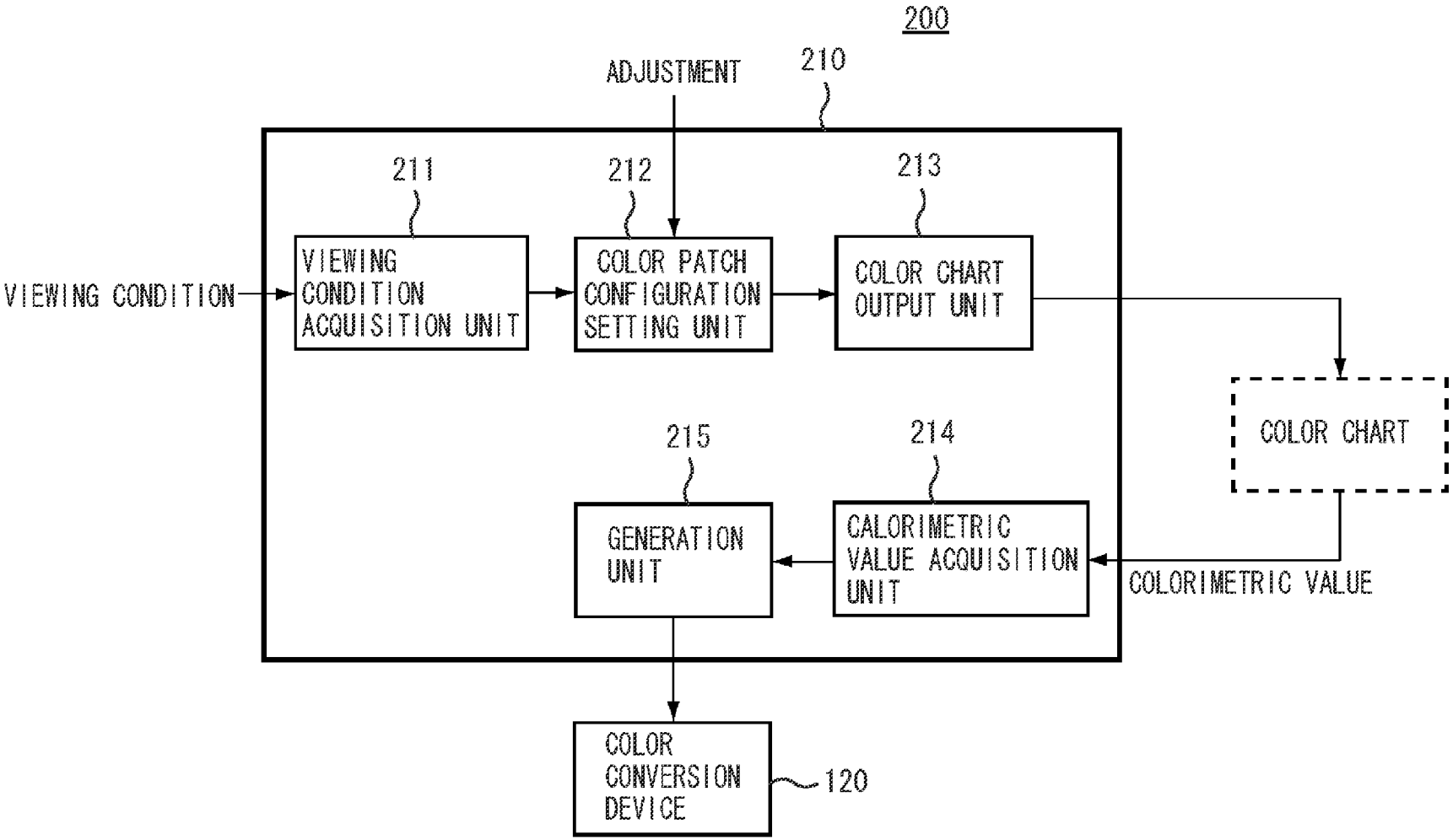
FIG. 8 is a schematic view illustrating an example of schematic configuration of a color processing system according to a second exemplary embodiment.

FIG. 8 is a schematic view illustrating an example of a schematic configuration of a color processing system 200 according to a second exemplary embodiment. The color processing system 200 in the second exemplary embodiment is configured to include, as illustrated in FIG. 8, a color processing apparatus 210, and a color conversion apparatus 120. In the second exemplary embodiment, since the color conversion apparatus 120 is similar to the one in the first exemplary embodiment illustrated in FIG. 1, similar reference numerals are assigned. Further, the color processing apparatus 210 is configured to include a viewing condition acquisition unit 211, a color patch configuration setting unit 212, a color chart output unit 213, a colorimetric value acquisition unit 214, and a generation unit 215.

The viewing condition acquisition unit 211 acquires a viewing condition such as a type of alight source and a color temperature of an environment in which a user views an output product of a color image, and a reference viewing condition which serves as a reference.

The color patch configuration setting unit 212 sets a color patch configuration which is output as a color chart, according to the viewing condition (furthermore, adjustment result of the color patch configuration) acquired by the viewing condition acquisition unit 211.

The color chart output unit 213 outputs the color chart of the color patch configuration based on the setting by the color patch configuration setting unit 212, to an output medium.

The colorimetric value acquisition unit 214 acquires colorimetric values obtained when the color chart output from the color chart output unit 213 to the output medium is color-measured using a calorimeter or the like.

The generation unit 215 generates a profile concerning a color processing condition suitable for the viewing condition acquired by the viewing condition acquisition unit 211, based on the colorimetric values acquired by the colorimetric value acquisition unit 214.

Figure 9:
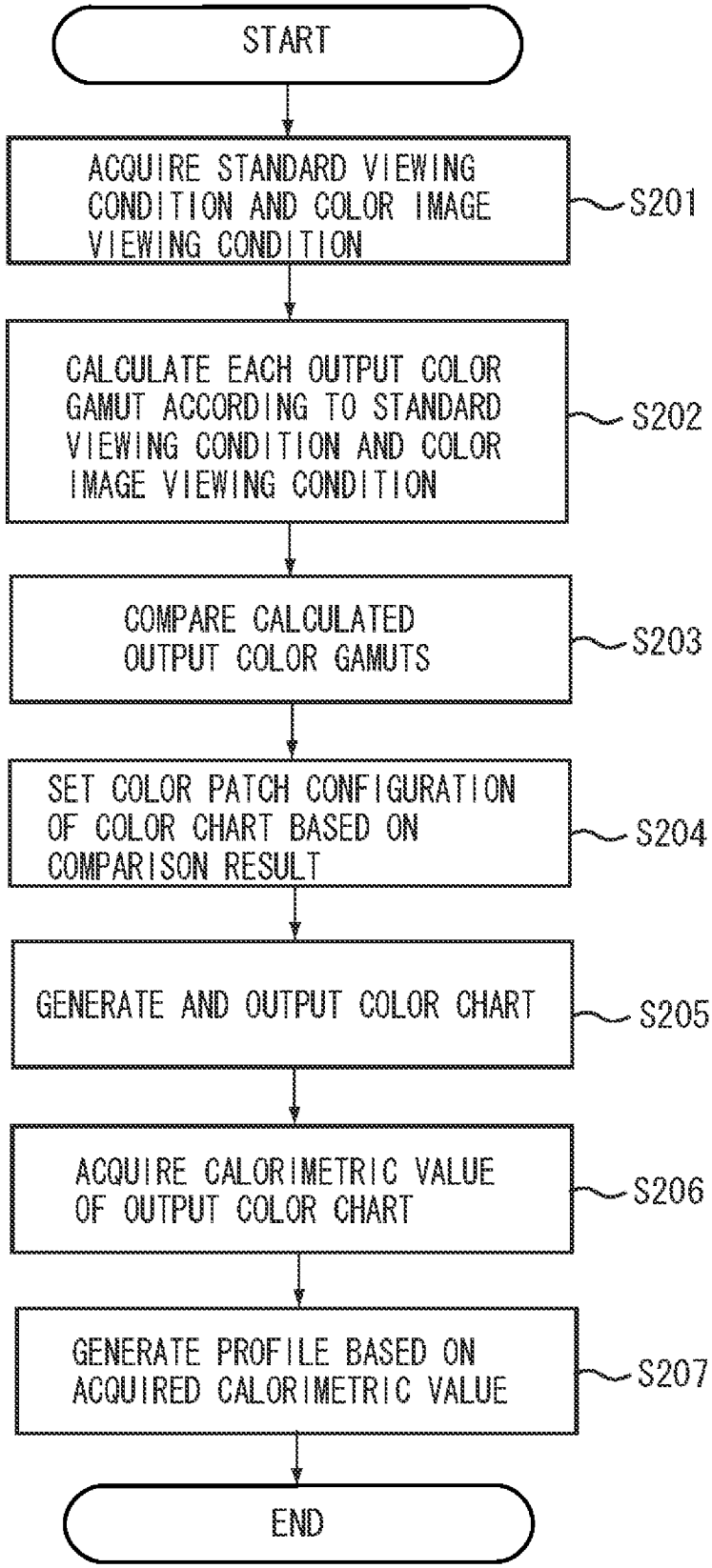
FIG. 9 is a flowchart illustrating the second exemplary embodiment, and illustrating an example of a procedure of a color processing method in the color processing apparatus illustrated in FIG. 8.

Next, a processing procedure of the color processing in the color processing apparatus 210 illustrated in FIG. 8 will be described. FIG. 9 is a flowchart illustrating the second exemplary embodiment, and illustrating an example of a procedure of a color processing method in the color processing apparatus 210 illustrated in FIG. 8. In the flowchart illustrated in FIG. 9, implementing the color processing suitable for the desired viewing condition, by dynamically generating a color patch configuration corresponding to a desired viewing condition from the reference color patch configuration suited to the reference viewing condition will be described.

In step S201 of FIG. 9, the viewing condition acquisition unit 211 acquires the reference viewing condition, and viewing condition under which a user views a color image. As the viewing condition to be acquired here, similarly to the first exemplary embodiment, it is desirable for a user to acquire, at least, information about a type of the light source and a color temperature of the light source. Further, the viewing condition, similarly to the first exemplary embodiment, can be also set by a desired method. In addition, as the reference viewing condition, arbitrary viewing condition may be set, but it can be set from an existing profile of a general light source such as D50 light source.

In step S202, for instance, the color patch configuration setting unit 212 calculates color gamuts, based on two types of viewing conditions (the reference viewing condition, and the viewing condition under which the user views a color image) acquired in step S201. A color gamut corresponding to the reference viewing condition (hereinafter, referred to as "reference color gamut") may be determined, for instance, from a profile or the like used when the reference viewing condition has been set in step S201. Further, the color gamut (hereinafter, referred to as "viewing color gamut") corresponding to the viewing condition of the color image may be measured and determined in advance, or the color gamut may be estimated and calculated by utilizing general color adaptation prediction formulae of the existing profile.

In step S203, for instance, the color patch configuration setting unit 212 compares device color gamuts (the reference color gamut and the viewing color gamut) under two viewing conditions calculated in step S202. When comparing the color gamuts, a desired method may be used. Comparison between the color gamuts, and an example of change of the color patch configuration will be illustrated below.

Figure 10A:
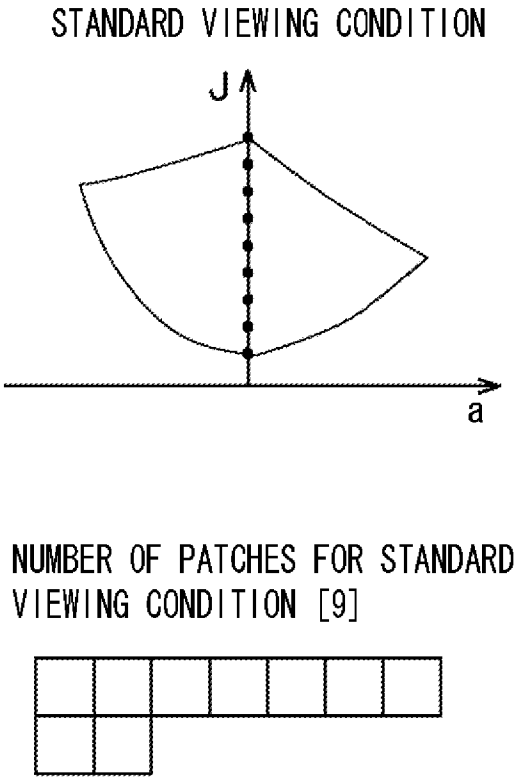
FIGS. 10A, 10B and 10C are schematic views illustrating the second exemplary embodiment, and illustrating change example of color patch configuration when lightness range of color gamut is changed.
Figure 10B:
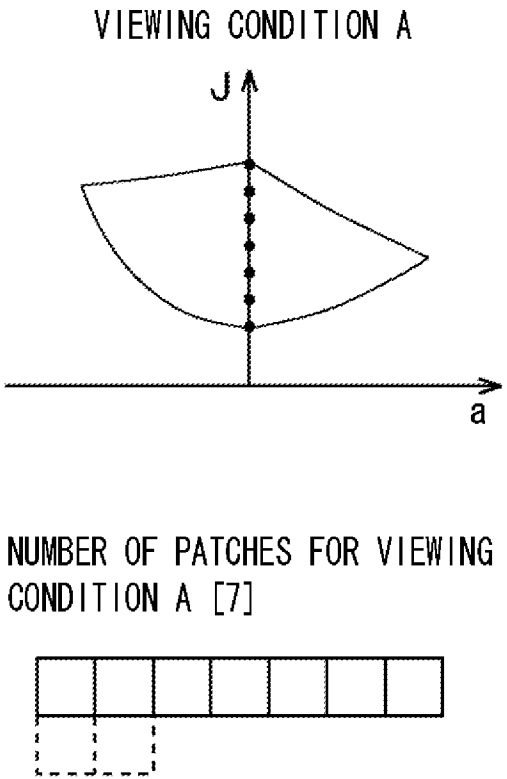
Figure 10C:
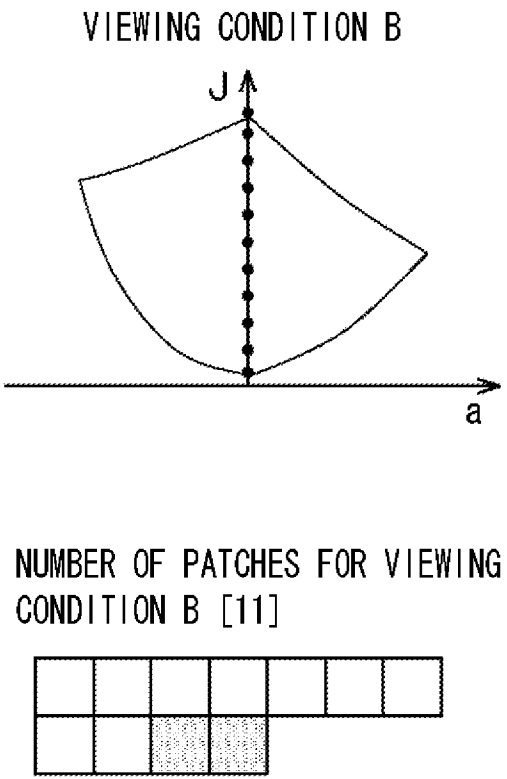

FIGS. 10A to 10C are schematic views illustrating the second exemplary embodiment, and illustrating an example of change of the color patch configuration when lightness ranges of the color gamuts are changed. Namely, FIGS. 10A to 10C illustrate an example of comparison between the lightness ranges. For instance, the color patch configuration setting unit 212 can perform comparison of the lightness ranges such as the ones illustrated in FIGS. 10A to 10C.

When a lightness range of a viewing color gamut is narrower (smaller) than a lightness range of the reference color gamut, like a viewing condition A illustrated in FIG. 10B, the color patches in corresponding lightness range can be reduced from a number of color patches in the reference viewing condition illustrated in FIG. 10A. On the other hand, when a lightness range of the viewing color gamut is broader (larger) than a lightness range of the reference color gamut, like the viewing condition B illustrated in FIG. 10C, the color patches in corresponding lightness range can be added.

In this process, the color patches to be reduced or added are changed dynamically depending on difference in the lightness range. Namely, as the difference becomes larger, an amount of change of the number of color patches becomes larger. Further, when the difference in the lightness range is small, it is possible that the number of color patches may not be changed.

Figure 11A:
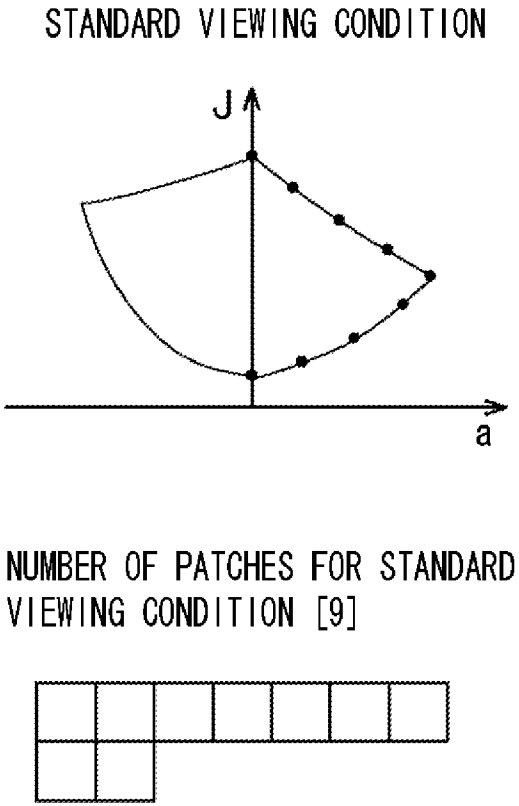
FIGS. 11A, 11B and 11C are schematic views illustrating the second exemplary embodiment, and illustrating a change example of the color patch configuration when a maximum color saturation of the color gamut is changed.
Figure 11B:
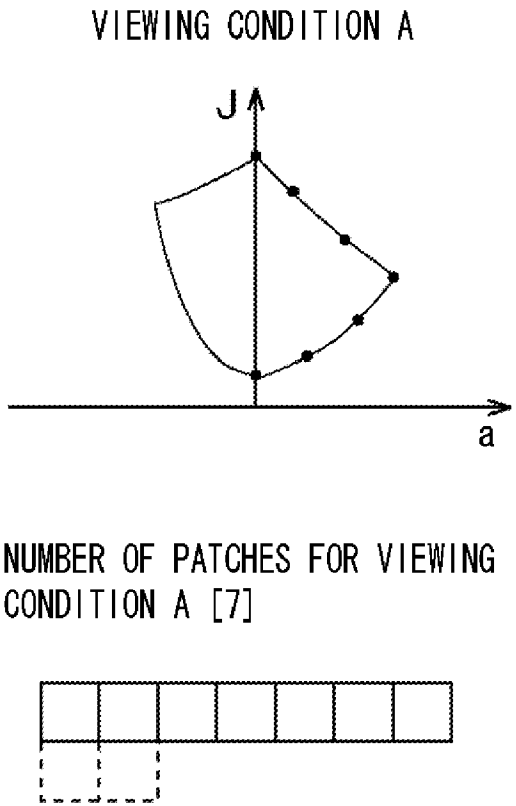
Figure 11C:
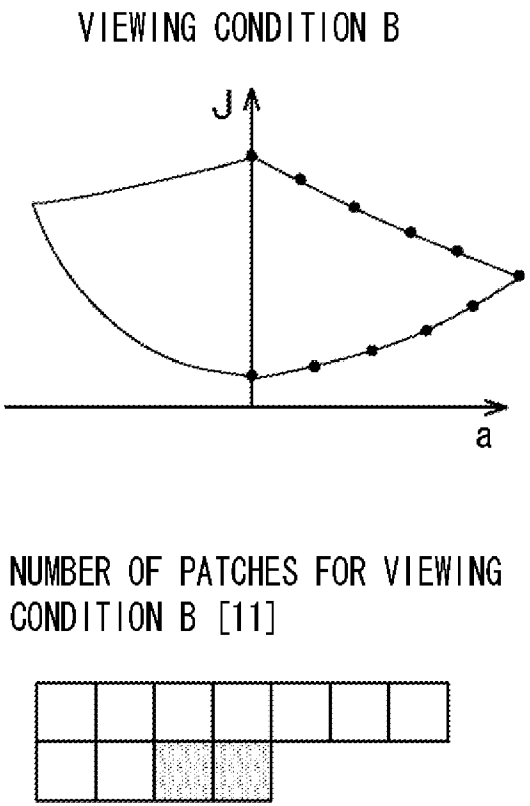

FIGS. 11A to 11C are schematic views illustrating the second exemplary embodiment, and illustrating an example of change of the color patch configuration when a maximum color saturation of the color gamuts is changed. Namely, FIGS. 11A to 11C illustrate an example in which color saturations in desired hue are compared to each other. For instance, the color patch configuration setting unit 212 can compare color saturations (maximum color saturations) to each other, as illustrated in FIGS. 11A to 11C.

When a maximum color saturation of the viewing color gamut is smaller than a maximum color saturation of the reference color gamut, like the viewing condition A illustrated in FIG. 11B, the color patches in corresponding hue can be reduced from a number of the color patches in the reference viewing condition illustrated in FIG. 11A. On the other hand, when a maximum color saturation of the viewing color gamut becomes larger than a maximum color saturation of the reference color gamut, like the viewing condition B illustrated in FIG. 11C, the color patches in corresponding hue can be added.

In this process, the color patches to be reduced or added are changed dynamically depending on difference in the maximum color saturation. Namely, as the difference becomes larger, an amount of change of the number of the color patches becomes larger. Further, when a difference in the maximum color saturation is small, it is possible that the number of the color patches may not be changed.

Figure 12A:
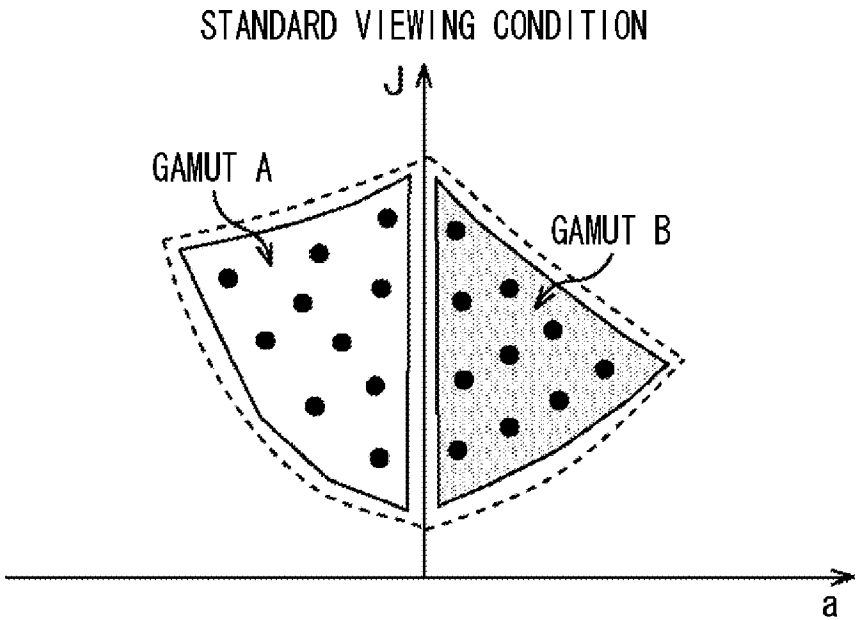
FIGS. 12A and 12B are schematic views illustrating the second exemplary embodiment, and illustrating a change example of the color patch configuration when a volume of the color gamut is changed.
Figure 12B:
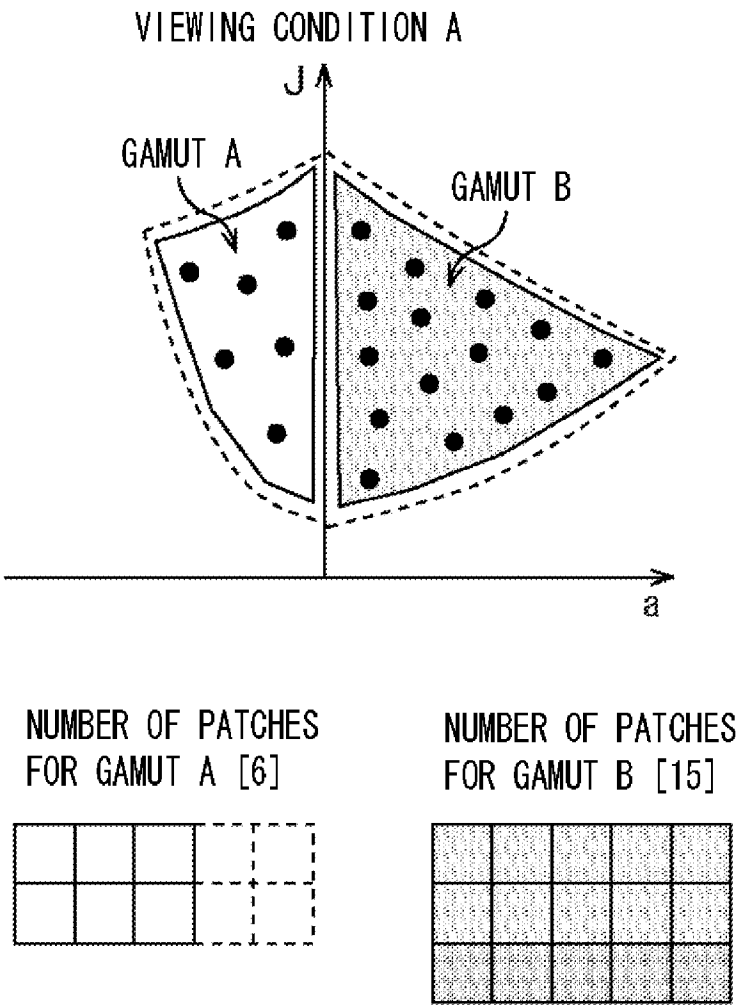

FIGS. 12A and 12B are schematic views illustrating the second exemplary embodiment, and illustrating an example of a change of the color patch configuration when volumes of the color gamuts have been changed. Namely, FIGS. 12A and 12B illustrate an example in which volumes of desired color gamuts are compared to each other, and are schematic views in which the volumes of desired color gamuts are mapped on Ja planes for the sake of convenience. For instance, the color patch configuration setting unit 212 can also compare volumes of the color gamuts to each other as illustrated in FIGS. 12A and 12B.

When a volume of the viewing color gamut in a gamut A becomes narrower (smaller) than a volume of the reference color gamut, like the viewing condition A illustrated in FIG. 12B, with reference to a number of the color patches in the reference viewing condition illustrated in FIG. 12A, the color patches contained in the gamut A can be reduced. On the other hand, when a volume of the viewing color gamut becomes broader (larger) than a volume of the reference color gamut, like a gamut B, the color patches contained in the gamut B can be added.

In this process, the color patches to be reduced or added are changed dynamically depending on difference in volumes. Namely, as the difference becomes larger, an amount of change of the number of the color patches becomes larger. Further, when the difference in volume is small, it is possible that the number of the color patches may not be changed.

Returning to FIG. 9, when the processing proceeds to step S204, the color patch configuration setting unit 212 sets the color patch configuration to be printed on a color chart, based on a comparison result in step S203. At this time, for instance, using a user interface (UI) illustrated in FIG. 13, the color patch configuration can be adjusted from the outside.

Figure 13:
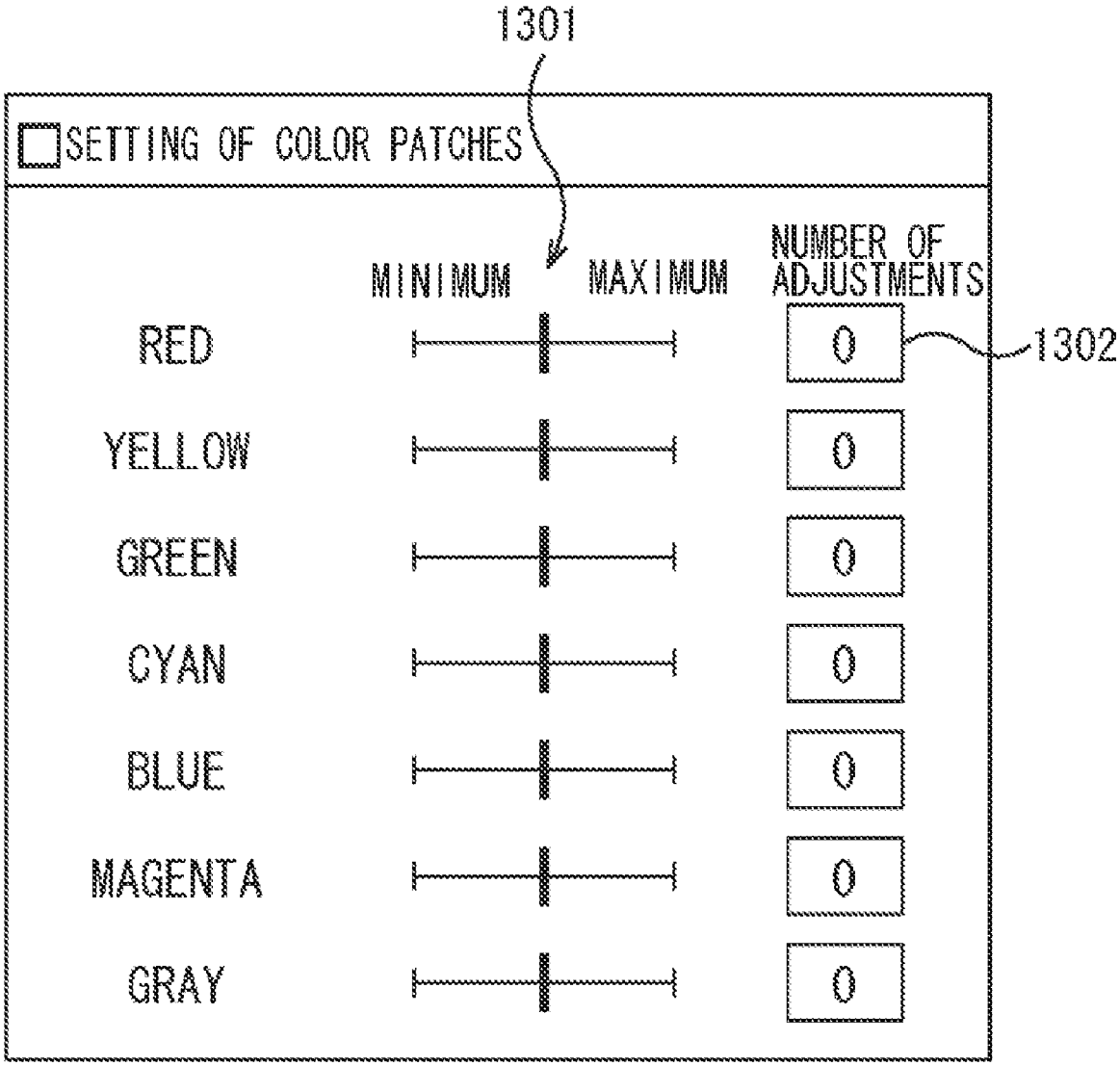
FIG. 13 is a schematic view illustrating the second exemplary embodiment, and illustrating an example of a user interface (UI) that is used when the color patch configuration is adjusted.

FIG. 13 is a schematic view illustrating the second exemplary embodiment, and illustrating an example of the user interface (UI) used when the color patch configuration is adjusted. In FIG. 13, addition and reduction of the color patches can be selected for each color region of RED, YELLOW, GREEN, CYAN, BLUE, MAGENTA, and GRAY, but a number of segmentations of the color gamuts and a segmentation method are not limited thereto. For instance, without segmenting the color gamut, the whole color gamut may be collectively adjusted, or surfaces of device color gamut may be individually set. Further, setting items may be individually provided concerning a color region where emphasis is particularly placed on the color reproduction such as skin color.

In FIG. 13, a slide bar 1301 adjusts increase or decrease of the number of the color patches for each color region. A minimum value and a maximum value of the slide bar 1301, for instance, as illustrated in FIGS. 10 to 12, can be defined depending on a comparison result of the color gamuts in step S203. Basically, in a color region where the viewing color gamut becomes larger than the reference color gamut, a lower limit of a minimum value becomes small, and an upper limit of a maximum value becomes large. On the other hand, in a color region where the viewing color gamut becomes smaller than the reference color gamut, the lower limit of the minimum value becomes large, and the upper limit of the maximum value becomes small.

Further, in FIG. 13, a display region 1302 is used to display increase or decrease of the number of the color patches for each color region. If a number of adjustments of the display region 1302 is positive, a number of the color patches of the applicable color region is increased. On the other hand, in the case of negative, the number of the color patches is reduced to form the color chart. If the number of adjustments of the display region 1302 is 0, the color chart will be formed with the same number of color patches as that of the reference color patches.

For instance, a user can adjust the color patch configuration, by instructing the color patch configuration setting unit 212 to adjust increase or decrease of the number of the color patches for each color region by adjusting the slide bar 1301 for each color region. A setting method of the color patch configuration in the color patch configuration setting unit 212 is not limited to the above-described exemplary embodiment. For instance, without adjusting the color patch configuration, the color patch configuration may be automatically set based on a comparison result of the color gamuts in step S203, or may be set using desired interface which is different from that in FIG. 13 after adjusting the color patch configuration.

Returning to FIG. 9, when the processing proceeds to step S205, the color chart output unit 213 generates the color chart, based on the color patch configuration set in step S204, and outputs the generated color chart to an output medium. After that, the color chart output to the output medium is, separately, color-measured using a calorimeter or the like. In this process, the data of the colorimetric values obtained by color measurement may be acceptable as long as a corresponding relationship between device-dependent color signal value and device-independent color signal value is established.

Next, in step S206, the colorimetric value acquisition unit 214 acquires the colorimetric values obtained when the color chart output to the output medium in step S205 is color measured using the calorimeter or the like.

In step S207, the generation unit 215 generates a profile concerning the color processing condition, based on the colorimetric values acquired in step S206. A profile concerning the color processing condition generated in the process is the same as that in the first exemplary embodiment. After that, similarly to the first exemplary embodiment, the color conversion processing is performed by the color conversion apparatus 120.

According to the second exemplary embodiment, setting/adjustment of the color patch configuration is performed in addition to the processing in the first exemplary embodiment, so that the color processing suited to the intended use can be performed, in addition to the benefits in the first exemplary embodiment.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

According to the above-described exemplary embodiment, appropriate color matching can be realized, even if the viewing environment changes.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-277142 filed Oct. 28, 2008, which is hereby incorporated by reference herein in its entirety.

What is claimed is:

1. A color processing apparatus comprising:

a viewing condition acquisition unit configured to acquire a viewing condition under which a user views a color image and a reference viewing condition which serves as a reference;

a color patch configuration setting unit configured to set a configuration of color patches corresponding to the viewing condition based on a result of comparison between a reference color gamut which is a color gamut corresponding to the reference viewing condition, and a viewing color gamut which is a color gamut corresponding to the viewing condition under which the user views the color image;

a generation unit configured to generate output data for outputting a color chart including color patches corresponding to the viewing condition based on the setting of the color patch configuration setting unit;

a colorimetric value acquisition unit configured to acquire colorimetric values of the color patches contained in the color chart obtained by outputting the output data using an output device;

the generation unit further configured to generate a profile concerning a color processing condition suited to the viewing condition, based on the colorimetric values acquired by the colorimetric value acquisition unit;

the color patch configuration setting unit is further configured to adds a number of the color patches depending on a difference between the viewing color gamut and the reference color gamut to a number of the color patches corresponding to the reference color gamut, and sets a configuration of the color patches if either a lightness range, a maximum color saturation, or a volume of the viewing color gamut is larger than those of the reference color gamut, and the color patch configuration setting unit reduces the number of the color patches depending on a difference between the reference color gamut and the viewing color gamut, from the number of the color patches corresponding to the reference color gamut, and sets a configuration of the color patches if either the lightness range, the maximum color saturation, or the volume of the viewing color gamut is smaller than those of the reference color gamut.

2. A color processing method comprising:

acquiring a viewing condition under which a user views a color image and a reference viewing condition which serves as a reference;

setting a configuration of color patches corresponding to the viewing condition based on a result of comparison between a reference color gamut which is a color gamut corresponding to the reference viewing condition, and a viewing color gamut which is a color gamut corresponding to the viewing condition under which the user views the color image;

generating output data for outputting a color chart including color patches corresponding to the viewing condition based on the configuration of color patches;

acquiring colorimetric values of the color patches contained in the color chart obtained by outputting the output data using an output device; and generating a profile concerning the color processing condition according to the viewing condition, based on the colorimetric values acquired in the colorimetric value acquired step.

adding a number of the color patches depending on a difference between the viewing color gamut and the reference color gamut to a number of the color patches corresponding to the reference color gamut, and sets a configuration of the color patches if either a lightness range, a maximum color saturation, or a volume of the viewing color gamut is larger than those of the reference color gamut, and the color patch configuration setting unit reduces the number of the color patches depending on a difference between the reference color gamut and the viewing color gamut, from the number of the color patches corresponding to the reference color gamut, and sets a configuration of the color patches if either the lightness range, the maximum color saturation, or the volume of the viewing color gamut is smaller than those of the reference color gamut.

3. A non-transitory computer-readable storage medium storing a program for a color processing apparatus, which causes a computer to execute a color processing method according to claim 2.

* * * * *